US006343579B1

(12) United States Patent
Yasuyama et al.

(10) Patent No.: US 6,343,579 B1
(45) Date of Patent: Feb. 5, 2002

(54) DECOMPRESSION SYSTEM FOR ENGINE

(75) Inventors: Susumu Yasuyama; Masaki Takegami, both of Iwata (JP)

(73) Assignee: Yamaha Hatsudoki Kabushiki Kaisha, Iwata (JP)

( * ) Notice: Subject to any disclaimer, the term of this patent is extended or adjusted under 35 U.S.C. 154(b) by 0 days.

(21) Appl. No.: 09/415,664

(22) Filed: Oct. 12, 1999

(30) Foreign Application Priority Data

Oct. 12, 1998 (JP) ..... 10-289482

(51) Int. Cl.[7] ..... F01L 13/08
(52) U.S. Cl. ..... 123/90.16; 123/182.1
(58) Field of Search ..... 123/182.1, 90.16, 123/90.17, 321, 322

(56) References Cited

U.S. PATENT DOCUMENTS 1,439,798 A * 12/1922 Crane ..... 123/182.1
1,604,704 A * 10/1926 Madden ..... 123/182.1
3,511,219 A * 5/1970 Esty ..... 123/182.1
4,440,126 A * 4/1984 Abermeth et al. ..... 123/321
4,455,977 A * 6/1984 Kuczenski ..... 123/182.1

* cited by examiner

*Primary Examiner*—Andrew M. Dolinar
(74) *Attorney, Agent, or Firm*—Ernest A. Beutler

(57) ABSTRACT

A push rod operated multi-valve V-type engine particularly adapted for use in motorcycles or like vehicles and which engine is air cooled. The engine employs a very simplified construction and overhead valve actuating mechanism utilizing push rods. The push rods are contained within push rod tubes formed at one side of the engine that provide a neat appearance and ease of servicing without adversely affecting the air cooling. A composite cylinder head construction is employed, as well as an improved lubricating system for the pair of driven camshafts. Furthermore, a decompression system is incorporated in the valve actuating mechanism to lower the compression ratio so as to facilitate starting.

7 Claims, 12 Drawing Sheets

DECOMPRESSION SYSTEM FOR ENGINE

BACKGROUND OF THE INVENTION

This invention relates to an internal combustion engine and more particularly to an improved decompression device for such engine.

As is well known, it is desirable to maintain a relatively high compression ratio for engines. By utilizing high compression ratios, greater specific output can be obtained. One disadvantage, however, with use of high compression ratios is that starting of the engine becomes more difficult. If electric starting is employed, the starter motor must be larger and more powerful as must be the drive between the starter motor and the engine. Where manual starting is utilized, the problems of high compression ratios are even greater.

There has been proposed, therefore, devices which operate so as to permit the engine to operate at a high compression ratio but which incorporate a device for reducing the compression ratio during starting. These decompression devices take many forms.

One way in which it is possible to reduce the compression ratio during starting is to open the exhaust valves for a brief period of time during the compression stroke. This will reduce the compression ratio and facilitate starting. The decompression device is then deactivated once the engine is started so that the maximum compression ratio can be enjoyed.

However, the provision of a mechanism for achieving this decompression is not as simple as it may appear. This is particularly true when the engine has multiple cylinders and multiple valves. It is basically desirable or even necessary to reduce the compression of all cylinders and this can be quite difficult and complex.

It is, therefore, a principal object of this invention to provide an improved and simplified arrangement for reducing the compression ratio than engine on starting.

It is a further object of this invention to provide an improved and simplified decompression device for engines having multiple valves and multiple cylinders.

SUMMARY OF THE INVENTION

This invention is adapted to be embodied in an internal combustion engine having a cam shaft with a plurality of cam lobes each of which cooperates with a follower for operating the valves of the engine. The cam shaft is formed with an axially extending bore in which an actuating cam member is supported for reciprocation. A plunger member is supported for reciprocation along an axis that is generally transversely disposed to this bore and which intersects at least one cam lobe in an area spaced from its tip portion. When the actuating cam member is moved in the bore, the plunger will be actuated and engage the follower and open the associated valve at a time during the stroke when the valve would normally be closed.

DETAILED DESCRIPTION OF THE PREFERRED EMBODIMENTS OF THE INVENTION

Figure 1:
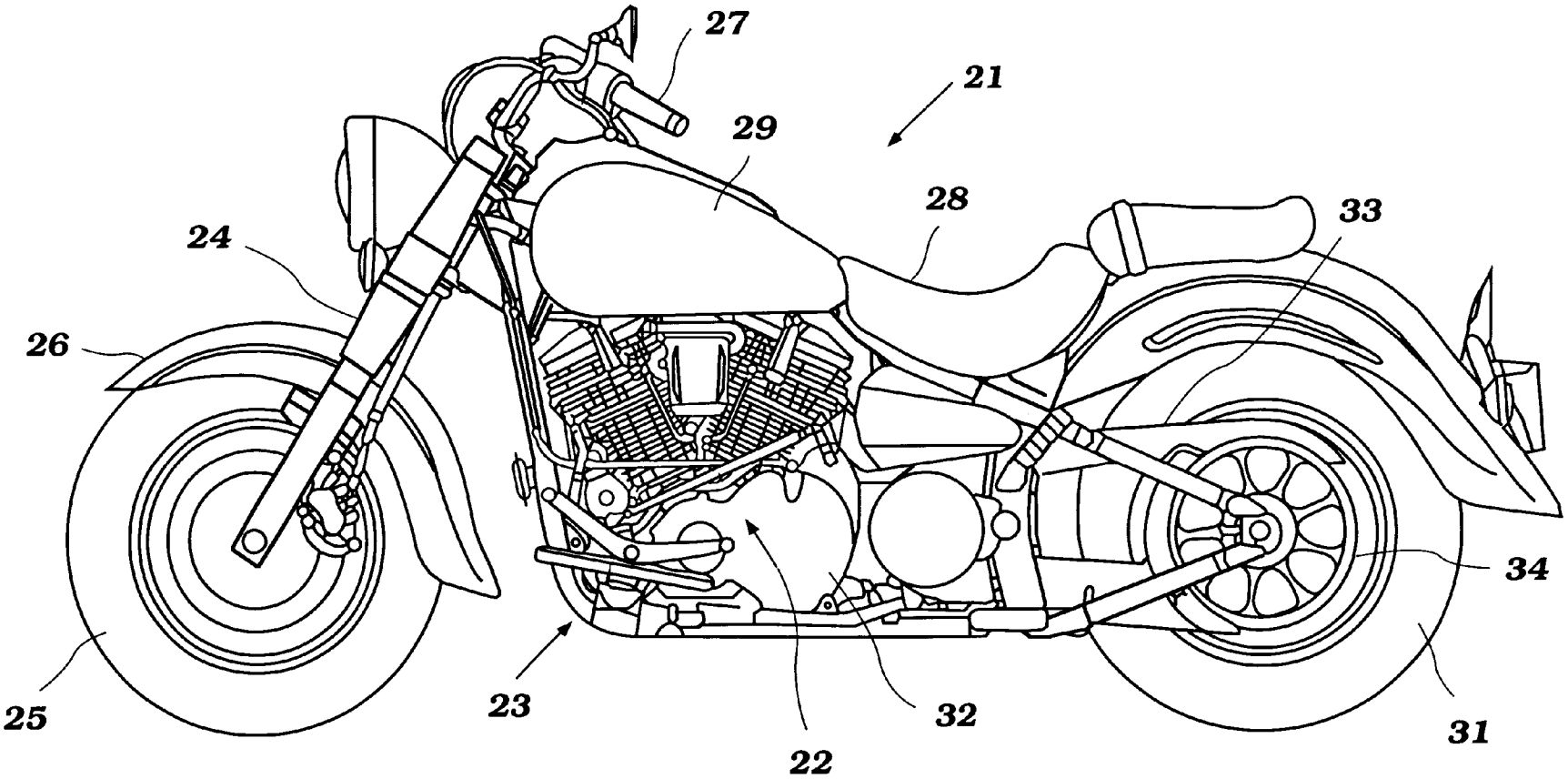
FIG. 1 is a side elevational view of a motorcycle constructed in accordance with an embodiment of the invention.

Referring first primarily to FIG. 1, a motorcycle is illustrated in side elevational view and is identified generally by the reference numeral 21. The motorcycle 21 is powered by an internal combustion engine, indicated generally by the reference numeral 22 and which is constructed in accordance with an embodiment of the invention. The motorcycle 21 is shown as a typical environment in which the invention may be utilized.

The invention has particular utility in conjunction with motorcycle applications because the engine 22 should have a high specific output and also must be compact in construction but nevertheless be easy to start. Although this specific environment is shown as a typical environment with which the invention may be utilized, it will be readily apparent to those skilled in the art how the features of the engine 22 can be utilized with a number of other applications.

The motorcycle 21 is comprised of a frame assembly 23 upon which the engine 22 is suspended in a known manner. This frame assembly 23 dirigibly supports a front fork 24 on which a wheel 25 is rotatably journaled. A fender 26 covers this front wheel 25. The steering of the vehicle is controlled by a handlebar assembly 27 that is fixed to the upper end of the front fork 24 in a manner well known in this art.

A rider's seat 28 is carried by the frame assembly 23 rearwardly of the engine 22 and above it. A fuel tank 29 for the engine is mounted on the frame 23 forwardly of the seat 28.

Finally, a rear wheel 31 is journaled by the frame assembly 23 in a suitable manner and is driven by a transmission contained within a crankcase transmission assembly 32 of the engine 22 through a final drive which may comprise a driving belt covered by a cover 33 for driving a pulley 34 or sprocket fixed for rotation with the rear wheel 31.

The construction of the engine 22 will now be described in more detail referring first primarily to FIGS. 2 and 3. In the illustrated embodiment, the engine 22 is of the V twin type and operates on a four cycle principle. To this end, the engine 22 is comprised of an engine body assembly including a cylinder block portion, indicated generally by the reference numeral 35, which is formed with a pair of angularly related cylinder banks 36 and 37 that are disposed at a V angle to each other. These cylinder banks 36 and 37 are formed by cylinder barrels that are affixed to an upper portion of a crankcase member 38 which with the cylinder banks 36 and 37 completes the cylinder block portion 35.

The crankcase member 38 defines a crankcase portion of the engine body that includes the combined crankcase transmission assembly 32 and rotatably journals a crankshaft 39 in any suitable manner.

Each cylinder bank 36 and 37 is formed with a respective cylinder bore 41 in which a piston 42 reciprocates. The pistons 42 are connected to the upper or small ends of connecting rods 43 in a known manner. The connecting rods 43 are journaled in side-by-side relationship on a throw of the crankshaft 39 as best seen in FIG. 3.

Figure 11:
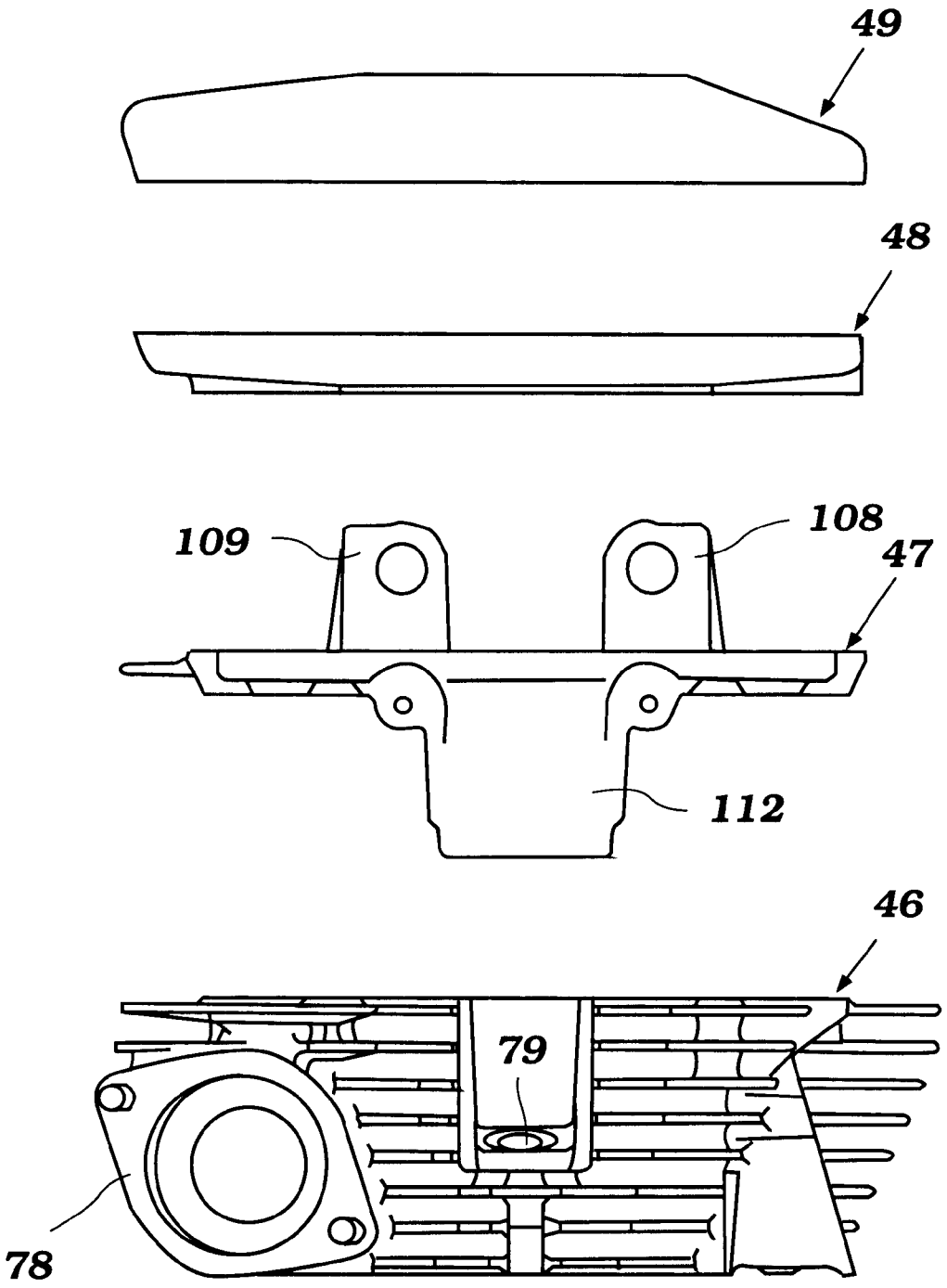
FIG. 11 is an exploded view showing one of the cylinder head assemblies.

A cylinder head assembly, indicated generally by the reference numeral 44 is affixed to each cylinder bank 36 and 37 by means that include threaded fasteners 45. The cylinder head assemblies 44 are each made up of four major components. These comprise a main cylinder head member 46, a camshaft carrier 47, a cylinder head cover 48 and a valve cover 49. These main components are shown in FIG. 11 and will be described in more detail later by reference to this and other figures.

Still continuing to refer primarily to FIGS. 2 and 3, the transmission assembly for driving the rear wheel 31 from the crankshaft 39 will now be described. As has been previously noted, this transmission assembly is contained in part in the combined crankshaft transmission assembly 32.

Affixed to one end of the crankshaft 39 is a main drive gear 51 which is enmeshed with a driven gear 52 of a change speed transmission, indicated generally by the reference numeral 53. The driven gear 52 is coupled via a selectively actuatable multiple disc clutch 54 to a primary shaft 55 of the change speed transmission 53.

This primary shaft 55 carries a plurality of primary gears which are enmeshed with secondary gears that are carried on a secondary shaft 56 of the transmission 53. By selectively coupling the gears on the primary and secondary shafts 55 and 56 to the shafts through a suitable shifting mechanism, it is possible to change the drive ratio between the crankshaft 39 and the secondary shaft 56. The secondary shaft 56 thus, functions as the output shaft of the change speed transmission 53.

An understanding of the details of the transmission 53 is not believed to be necessary to permit those skilled in the art to practice the invention. It should be readily apparent that the invention may be utilized in conjunction with any desired type of transmission.

The secondary transmission shaft 56 or output shaft carries a sprocket or toothed wheel 57 which is engaged with a drive belt 58. This drive belt 58 is contained within a transmission case enclosed by a cover assembly 59.

The drive belt 58 drives a further sprocket 61 that is coupled to a transmission output shaft 62. A further drive sprocket or pulley 63 is affixed to the opposite end of this output shaft 62. This belt drives the rear wheel sprocket 34 as previously noted.

The construction of the cylinder head assembly 44 will now be described by primary reference to FIGS. 3, 4 and 11–13. As has been previously noted, the cylinder head assembly 44 is made up of four major components, the main cylinder head member 46, the rocker arm carrier 47, the cylinder head cover 48, and the valve cover 49. These components are preferably formed from light alloy materials, such as cast aluminum or aluminum alloys.

The main cylinder head member 46 is formed with a recess 64 in its lower surface which overlies the cylinder bore 41 and forms the combustion chamber of each cylinder bank 36 and 37 with the head of the piston 42 and with the cylinder bore 41. In the illustrated embodiment, the cylinder head recess 64 is formed with four ports, two of which lie on the side of the engine toward the valley between the cylinder banks 36 and 37 and which comprise intake ports.

These ports are served and supplied with a fuel air charge by an induction system. This induction system includes carburetors 65 or other charge formers that are conveniently disposed between these cylinder banks 36 and 37 and which are associated with the intake passages of the respective cylinder head assemblies 44. These intake passages are shown partially in phantom in FIG. 4 and are identified by the reference numerals 66. These passages terminate in an outer surface 67 of each cylinder head member 46 and receive the respective carburetors 65.

Poppet-type intake valves 68 are slidably supported in each cylinder head member 46 by means that include valve guides 69. These valves 68 are urged toward their closed position in closing relationship to the intake ports, which appear in FIG. 4 and are identified by the reference numeral 71 by coil compression spring assemblies 72. These spring assemblies 72 act against keeper retainer assembly 73 for holding the valve 68 in their closed position. The mechanism for opening the valve 68 will be described later.

On the side of the cylinder head recesses 64 opposite the intake ports 71, there are provided exhaust ports. These exhaust ports are valved by poppet-type exhaust valves 74 which are also reciprocally mounted in the cylinder head members 46 by means of valve guides 75. Coil compression spring assemblies 76 act against keeper retainer assembly 77 for holding the exhaust valves 74 in their closed position. These exhaust valves 74 are opened in a manner which will also be described shortly.

The exhaust ports in the cylinder head members 46 terminate in respective exhaust outlet openings 78 formed in the cylinder head members 46 and which are adapted to detachably received an exhaust system for discharging the exhaust gasses from the combustion chambers to the atmosphere. Since the exhaust system constitutes no part of the invention, it has not been illustrated and will not be described. Those skilled in the art will readily understand how the invention can be utilized with a wide variety of types of exhaust systems.

The four valve per cylinder cylinder head assembly 44 as thus far described is further complimented by a means of a dual ignition system. To this end, the cylinder head members 46 are each formed with a pair of tapped openings 79 that receive spark plugs 81 as best seen in FIG. 3. These spark plugs 81 are fired by a suitable ignition system and will ensure rapid flame propagation and complete combustion of the fuel air charge that has been delivered to the combustion chambers from the carburetors 65. At this point, it might be well to state that although the invention is described in conjunction with a carbureted engine, the principles of the invention can be equally as well utilized with engines having other types of charge formers, such as fuel injection systems.

The valve operating mechanism for operating the intake valve 68 and exhaust valves 74 for each cylinder bank will now be described by particular reference to FIGS. 4–10, although this valve operating mechanism also appears in other figures.

First, it should be noted that the crankcase member 38 is formed with an internal wall that has a central opening 82 through which one and of the crankshaft 39 extends. A timing gear 83 is affixed for rotation with this end of the crankshaft 39 by means that include a fastener assembly 84 and key arrangement so that the timing gear 83 will be driven at crankshaft speed. The wall of the crankcase member through which the crankshaft extends is formed with a cylindrical projection indicated in the drawings by the reference numeral 85 for reference purposes.

Figure 7:
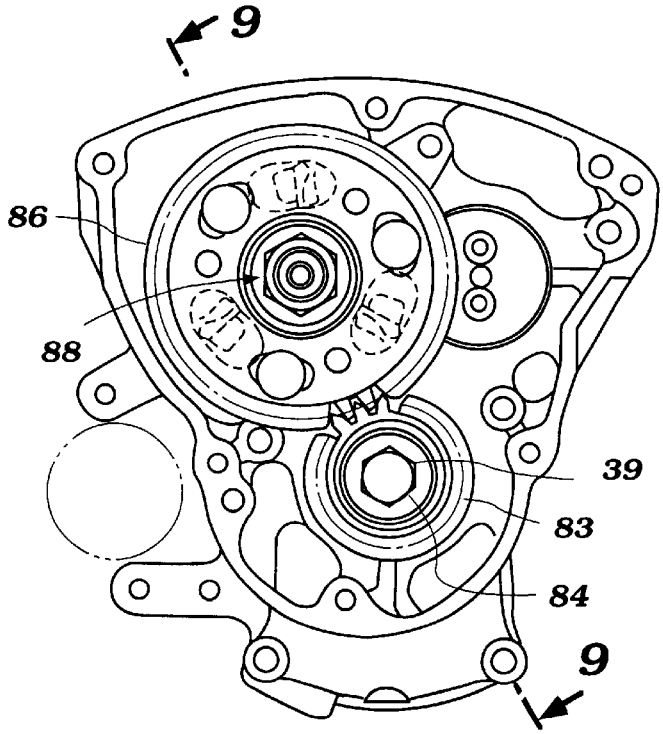
FIG. 7 is a view looking in the same direction as FIGS. 5 and 6 but shows the decompression mechanism associated with the engine.
Figure 9:
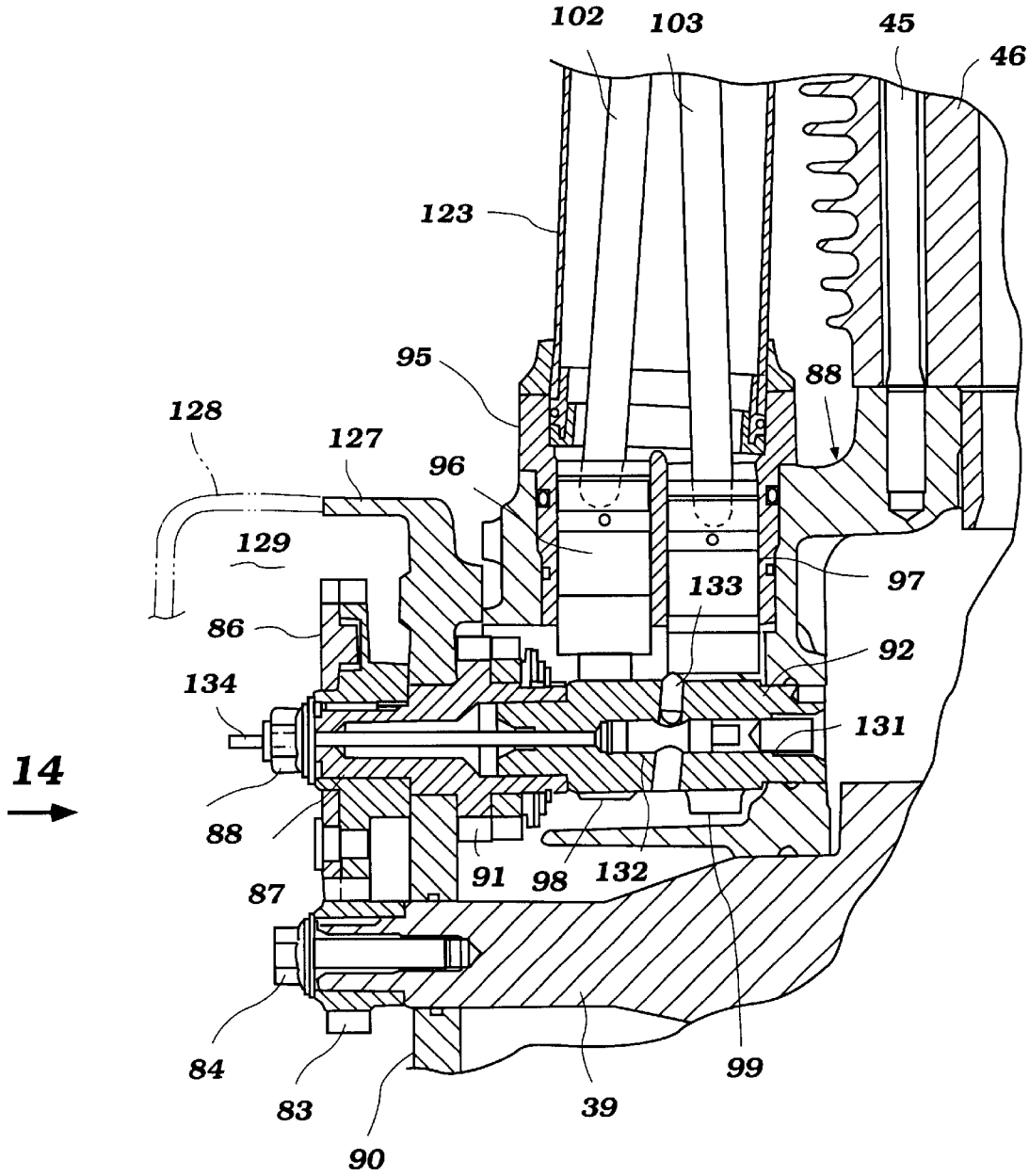
FIG. 9 is an enlarged cross-sectional view taken along a line 9—9 of FIG. 7 and shows the decompression actuating mechanism.
Figure 10:
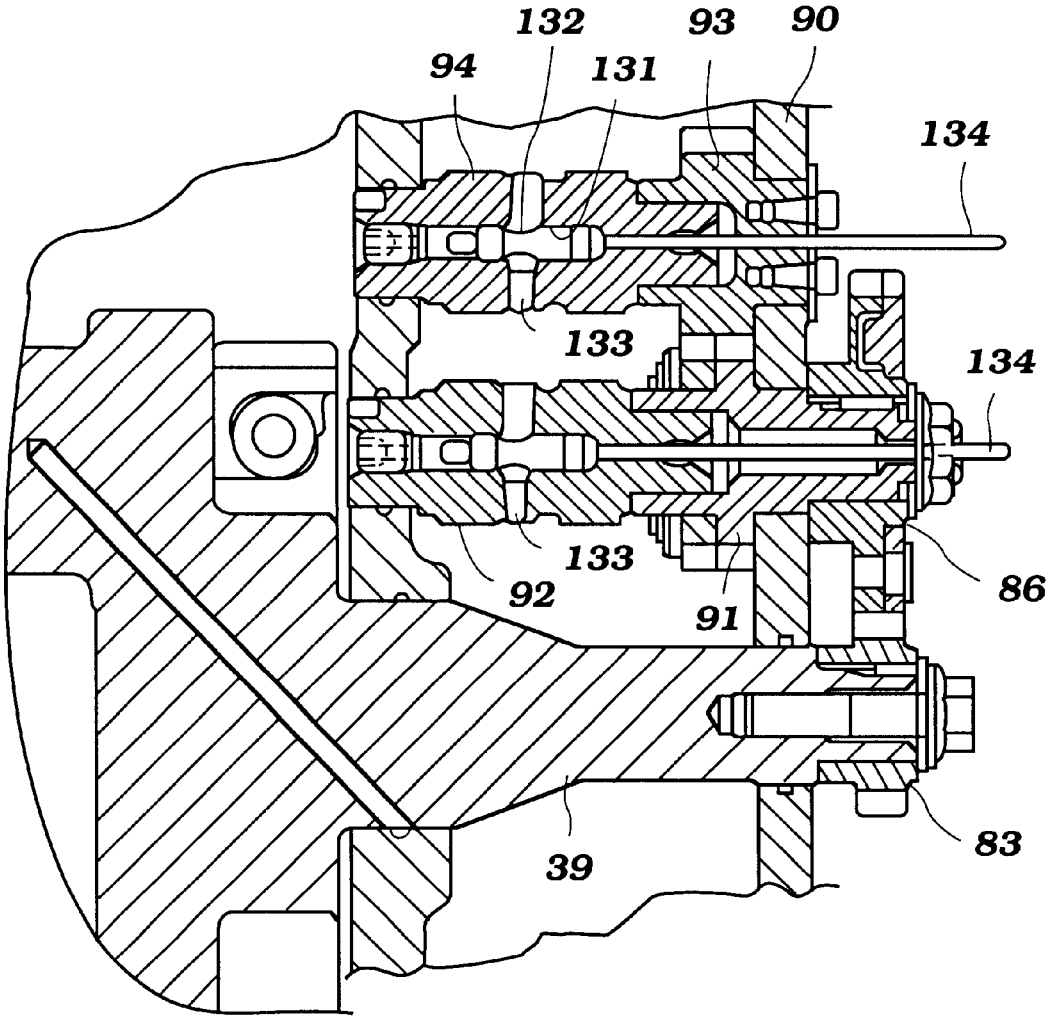
FIG. 10 is a view looking generally in the direction perpendicular to that of FIG. 9 and shows the interrelationship between the decompression mechanism for each cylinder bank.

As best seen in FIGS. 7, 9 and 10, the timing gear 83 is encircled by the projection 85 and is in this area enmeshed with a driven camshaft timing gear assembly, indicated generally by the reference numeral 86. This timing gear assembly 86 is of the split gear type so as to take up backlash in the system. This assembly is held onto a cam driving shaft 87 by means of a threaded fastener 88.

This shaft 87 penetrates through a cover 90 that forms a gear case with the wall projection 85 and there drives a first camshaft driving gear 91 which has a driving relationship with a first camshaft 92 which is associated with one of the cylinder banks 36 and 37. In the illustrated figures, this is the cylinder bank 37.

Figure 8:
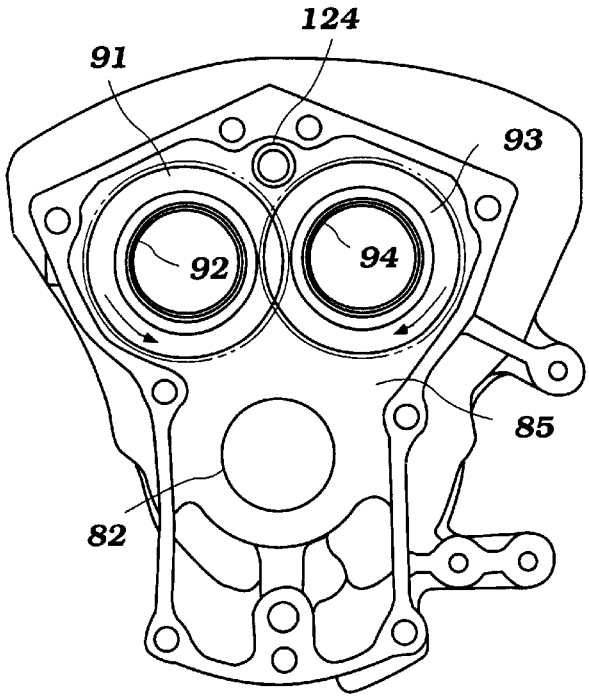
FIG. 8 is a view looking in the same direction as FIG. 7 and showing the construction for the timing drive to interrelate the camshaft so that they will rotate in opposite directions from each other.

The driving gear 91 is also a split-type backlash take up type of gear and is drivingly coupled to a second camshaft driving gear 93 which is associated with a camshaft 94 for the remaining cylinder bank, i.e., the cylinder bank 36. Because of this relationship between the driving gears 91 and 93, these gears will rotate in opposite directions as seen in FIG. 8. This is done for a reason which will become more apparent shortly.

The area above the crankcase member projection 38 adjacent each camshaft 92 and 94 and on the upper side thereof is formed with an opening that receives a tappet body 95. Each tappet body 95 is formed with a pair of bores that receive, respectively, an intake tappet 96 and an exhaust tappet 97 for the respective cylinder banks. These tappets 96 and 97 are engaged by the intake and exhaust cam lobes 98 and 99, respectively, of each camshafts 92 and 94. Since the construction of each camshaft is basically the same, except for the fact that they rotate in opposite directions, the same reference numerals are applied to the cam lobes 98 and 99 and the tappet bodies 96 and 97 for each cylinder bank.

As has been noted, the engine 22 is air cooled and to this end, both the cylinder barrels 36 and 37 are formed with cooling fins 101. These cooling fins 101 extend generally around the periphery of the engine body, but are partially interrupted on the sides adjacent the camshaft 92 and 94 so as to provide recesses through which push rods 102 and 103 for each cylinder bank extend. The push rods 102 are associated with the intake tappets 96, while the push rods 103 are associated with the exhaust tappets 97. These push rods 102 and 103 extend upwardly and in effect cross over each other slightly as seen in FIG. 2. These push rods 102 and 103 are encircled by a protective tube in a manner which will be described shortly.

Referring now primarily to FIGS. 4 and 11–13, the intake and exhaust valve push rods 102 and 103, respectively, extend upwardly along the side of the respective cylinder barrels 36 and 37 to the cylinder head assemblies 44. The upper end of each of these push rods 102 and 103 cooperate with respective rocker arms 104 and 105 that are supported for pivotal movement on rocker arm shafts 106 and 107.

These rocker arm shafts 106 and 107 are journaled in bosses 108 and 109, respectively, formed in the cylinder head top piece 47. As may be best seen in FIG. 12, the rocker arms 102 and 103 pass through a central opening 111 formed in a downwardly extending guide portion 112 of the rocker arm carrier 47.

The rocker arms 104 and 105 have follower portions 113 and 114 that define spherical sockets into which the ends of the push rods 102 and 103 extend. These extensions 113 and 114 are formed at one side of the rocker arm assemblies 104 and 105. At the other ends thereof, the rocker arm assembly 104 has a pair of extending arms 115 and 116 that are engaged with the tips of the intake valves 48 for their actuation. An adjusting screw 117 is provided on only one of these rocker arm extensions, this being the extension 115, so as to permit adjustment of the lash in the intake valve train.

In a similar manner, the rocker arm 105 has a pair of valve actuating portions 118 and 119 that cooperate with the tips of the stems of the exhaust valves 74 for their actuation. Again, only the rocker arm portion 118 carries an adjusting screw 121 for adjusting the lash in the exhaust valves.

Figure 12:
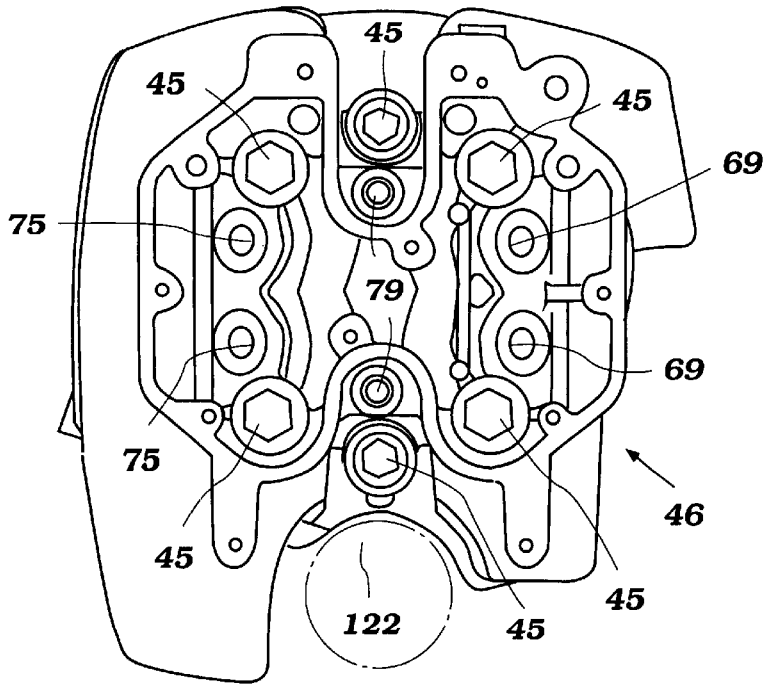
FIG. 12 is a top plan view of the cylinder head assembly with the rocker arm carrier not yet installed.
Figure 13:
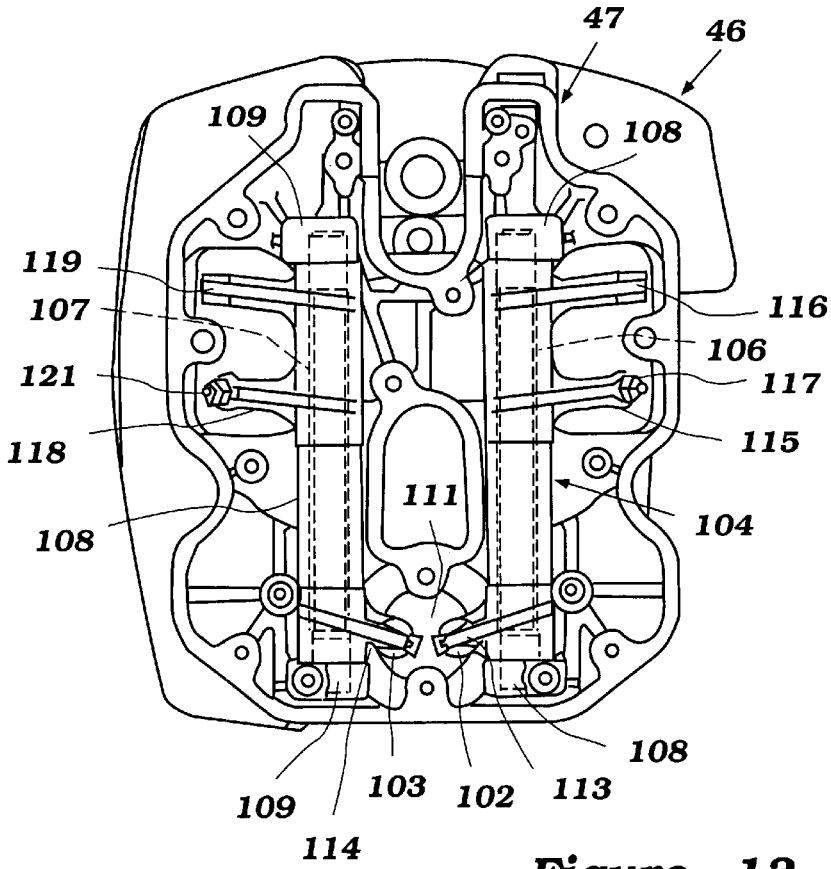
FIG. 13 is a is a view looking in the same direction as FIG. 12 but shows the rocker arms journalling portion of the cylinder head assembly installed and with only the valve cover removed.

As may be best seen in FIG. 12, the cylinder head member 46 has openings to receive the fasteners 45 that affix the cylinder head member 46 to the cylinder blocks 36 and 37 and this assembly to the crankcase member 38. The rocker arm carrier 47 is suitably affixed to the cylinder head member 46. The head cover 48 is then fixed to the upper side of the rocker arm carrier 47 and the valve actuating mechanism is then closed by the valve covers 49.

Figure 2:
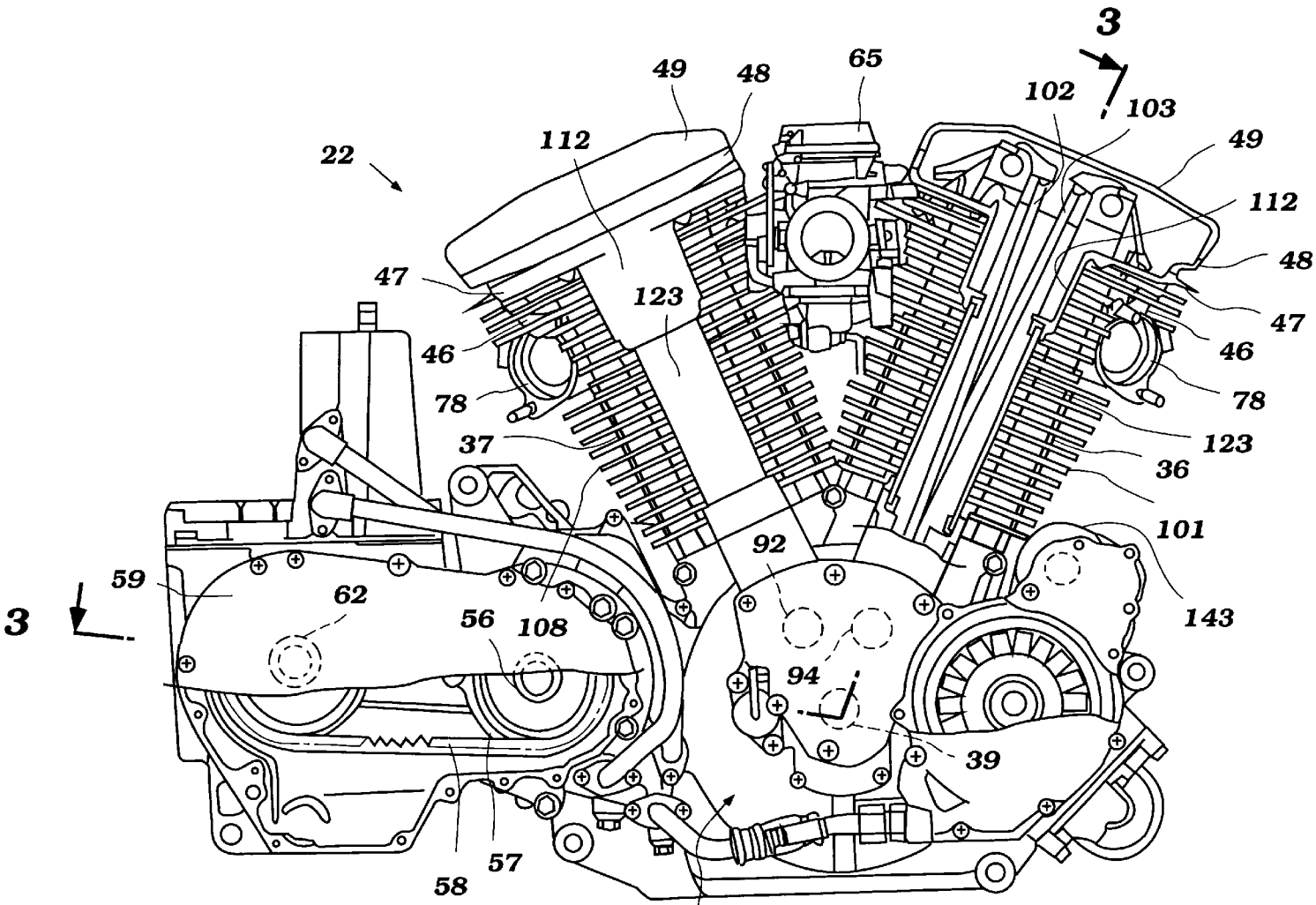
FIG. 2 is a side elevational view of the engine looking in the opposite direction from FIG. 1 and with the push rod covers either partially or completely removed and other portions broken away to show the valve operating mechanism.
Figure 3:
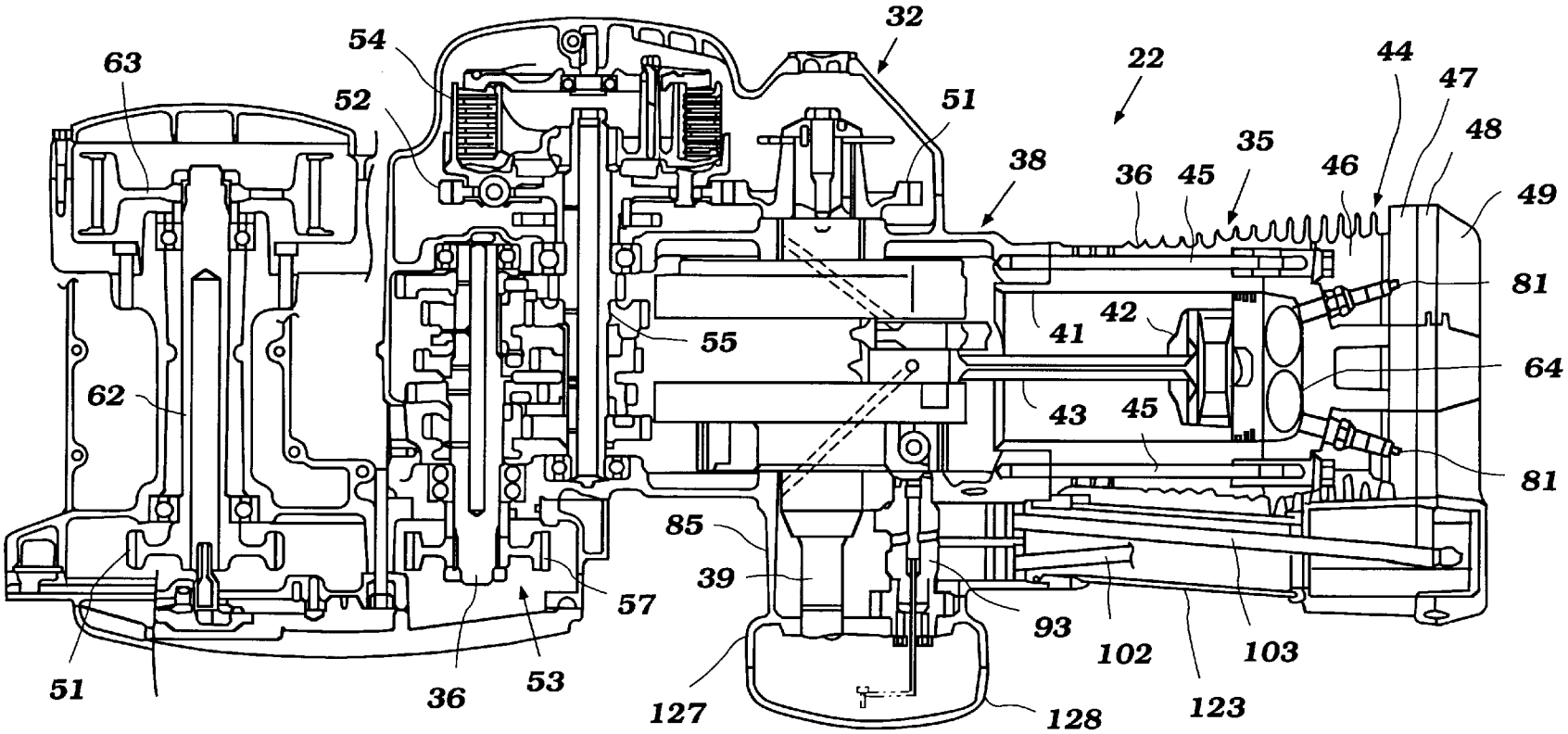
FIG. 3 is a cross-sectional view taken generally along the line 3—3 of FIG. 2.

As best seen in FIGS. 2, 3 and 12, the cylinder blocks 36 and 37 have recesses formed in one side thereof which are indicated generally by the reference numeral 122 that appears in FIG. 12. The push rods 102 and 103 extend through these recesses and are encircled by push rod tubes 123. As seen in FIG. 9, the lower ends of these push rod tubes 123 are sealingly engaged with the tappet carrier member 95 that is fixed to the crankcase member 38 and thus provide a good seal and protection in this area.

Figure 4:
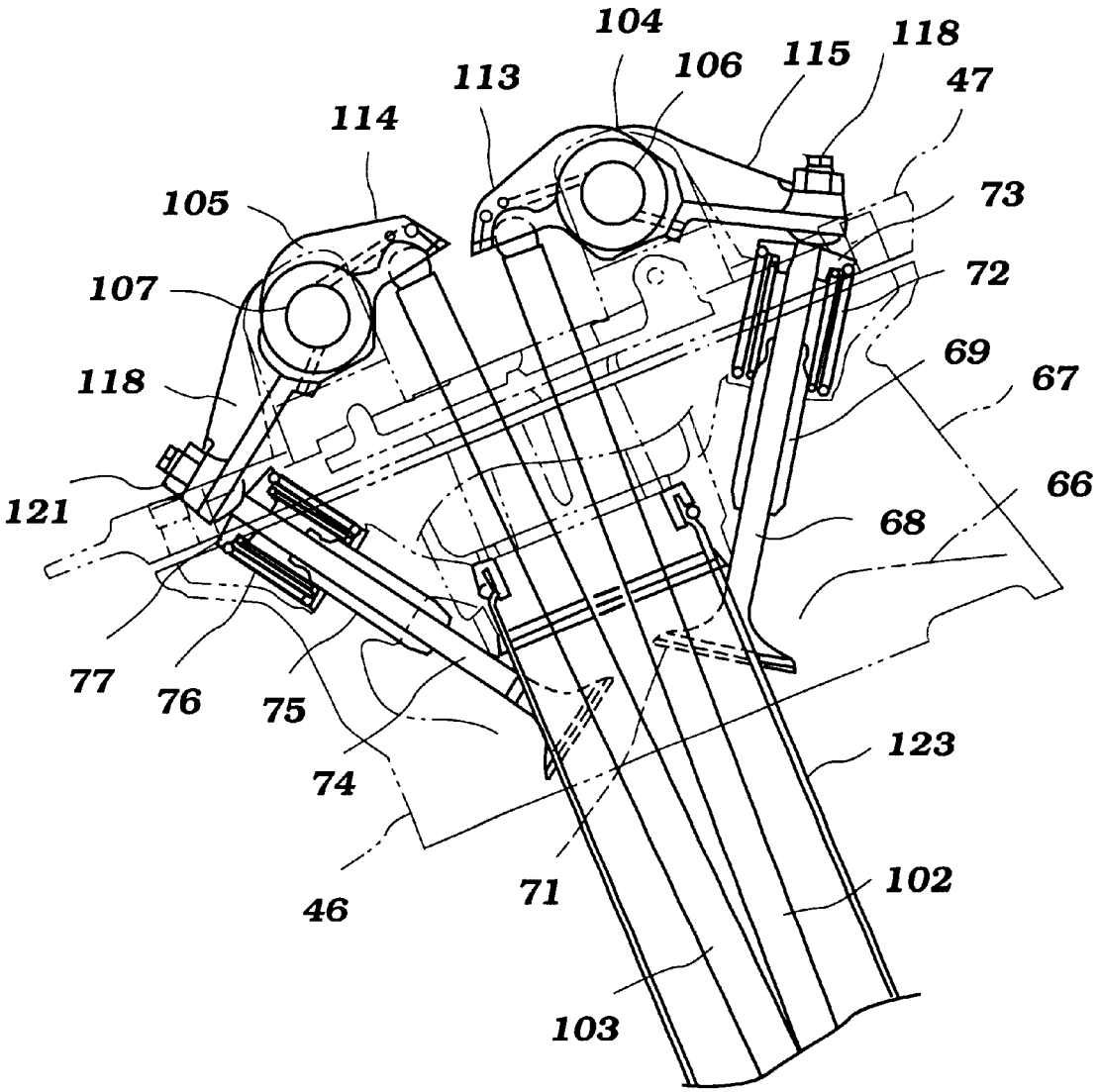
FIG. 4 is an enlarged view showing the valve operating mechanism associated with one of the cylinder heads with the main cylinder head component being shown in phantom.

In a like manner, the upper ends of these push rod tubes 123 are sealingly engaged within the projections 112 of the rocker arm carrier 47 as may be seen in FIGS. 2 and 4 and thus, the push rods 102 and 103 are well protected, but there is a neat overall appearance to the engine. Also, the push rods 102 and 103 can be easily removed for servicing, as should be readily apparent.

A lubrication system for the camshafts 92 and 94 and particularly their point of engagement with the tappets 97 is provided. This arrangement may be best understood by reference to FIG. 5.

As may be seen, the crankcase member 38 is provided with an oil gallery 124 that extends in the area between the rotational axes of the camshafts 92 and 94 and vertically upwardly therefrom between the tappets 97. This oil gallery 124 is drilled with feeder ports 125 and 126, respectively, which are directed toward the area where the lobes 98 and 99 of the camshafts 92 and 94 engage the respective tappets 97.

Figure 5:
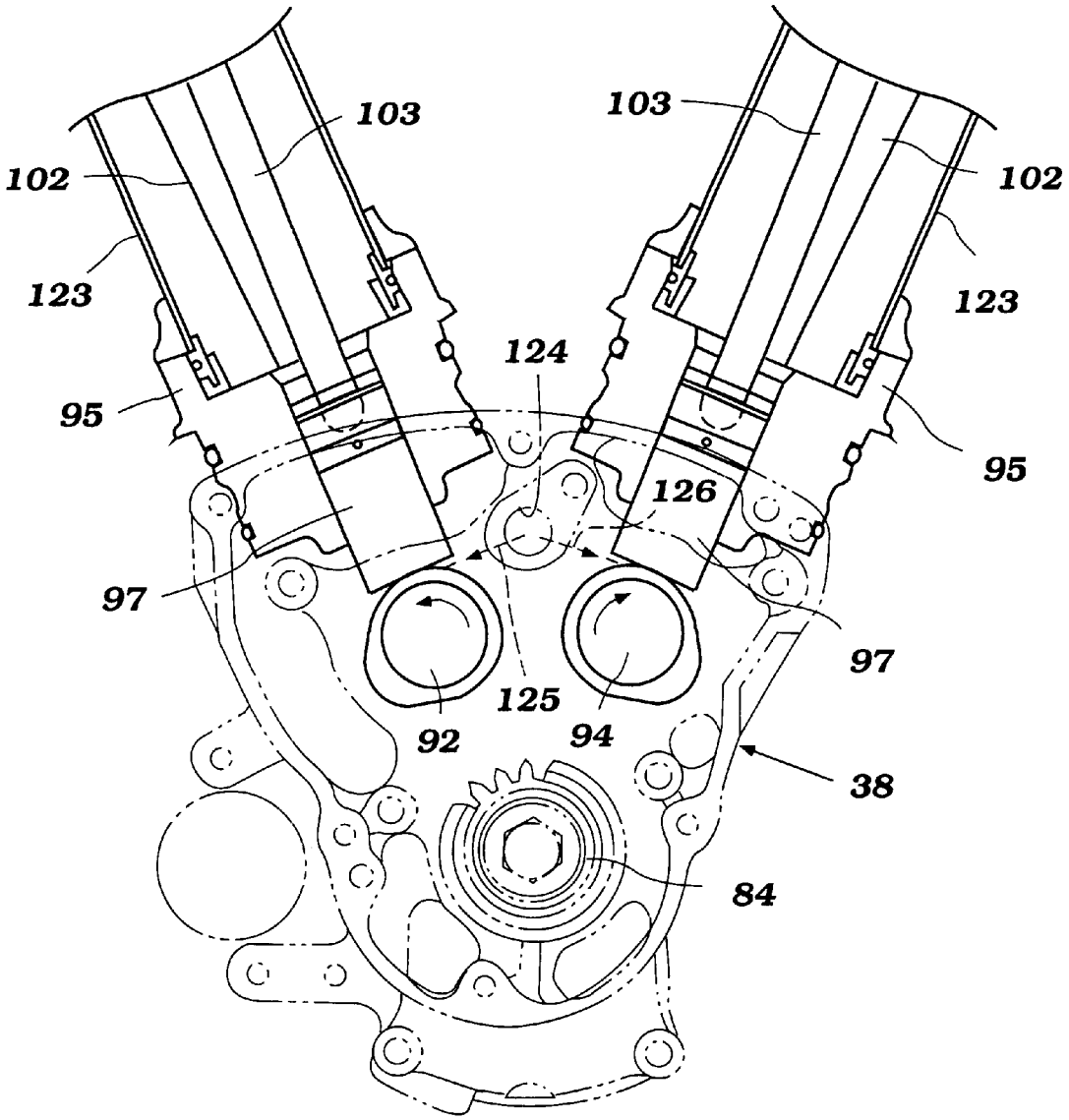
FIG. 5 is a view showing the lower ends of the push rods the upper ends of which are shown in FIG. 4 and their driving relationship with the camshafts journaled within the crankcase.
Figure 6:
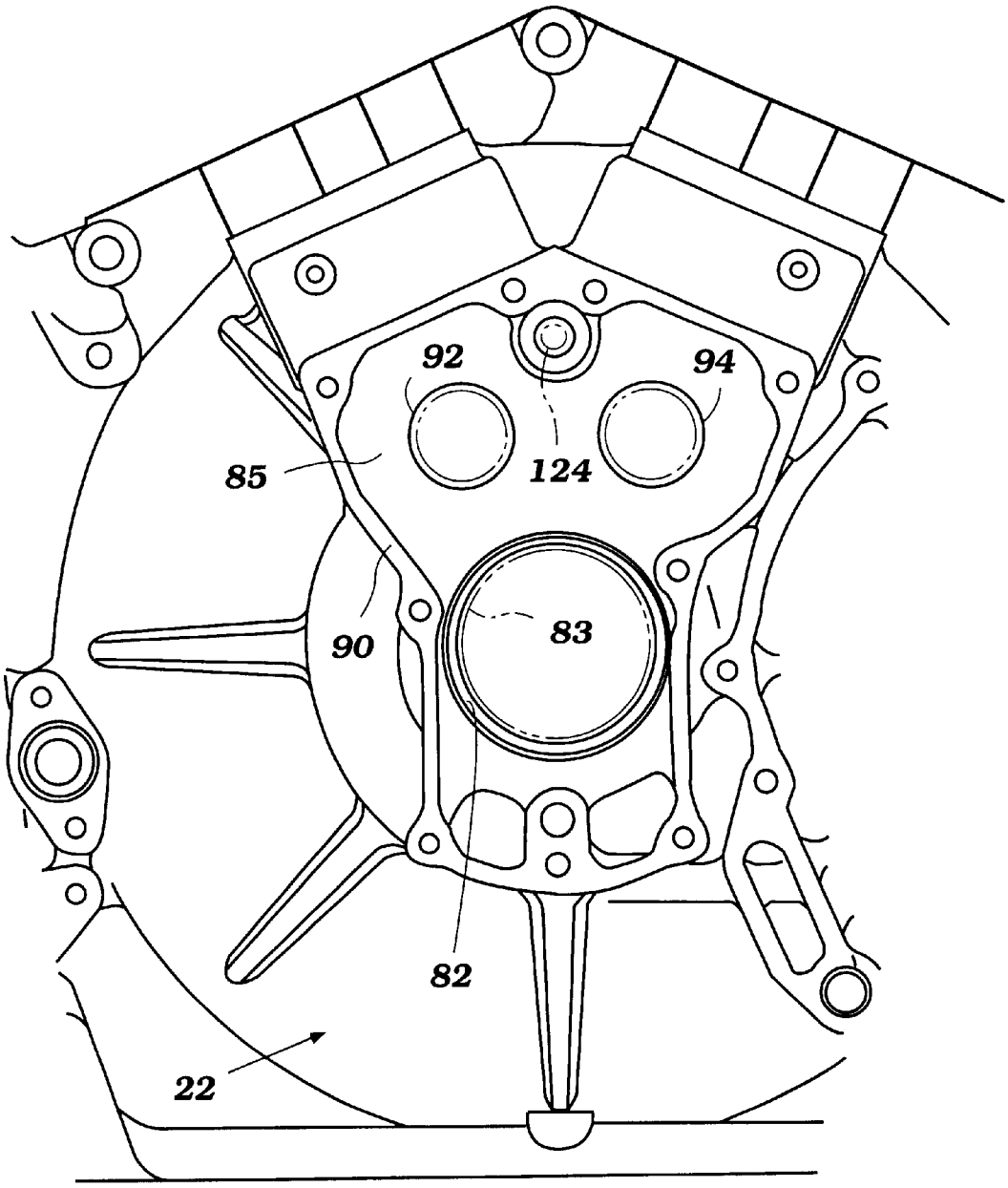
FIG. 6 is a view looking in the same direction as FIG. 5 but with the camshafts and crankshaft removed and showing more clearly the arrangement utilized to lubricate the camshaft operating mechanism.

It should be remembered that the camshafts 92 and 94 rotate in opposite directions as seen by the arrows in FIG. 5. As a result of this, the lubricant that is sprayed by the feeder ports 125 and 126 will be engaged with the cam surfaces that are rotating into engagement with the follower portions of the tappets 97. Therefore, lubricant will be carried by the rotation into this area so that there will be provided adequate and copious amounts of lubrication for the cam mechanism and the tappets 96 and 97.

Finally, and as the main feature of the invention, the engine 22 is provided with a decompression mechanism for facilitating starting. This decompression mechanism is shown best in FIGS. 9 and 10 with its actuating system being shown in FIGS. 14 and 15.

Referring first to FIGS. 9 and 10 and as has been noted, there is a timing drive for driving the camshafts 92 and 94 from the crankshaft 39 at one half crankshaft speed. This timing mechanism is contained within a timing case formed by an outwardly extending flange 127 of the crankcase cover piece 90. A timing case cover 128 is affixed to and encloses the timing gear drive and specifically the intermeshing gears 83 and 86 within this case, indicated by the reference numeral 129.

Each of the camshafts 92 and 94 is formed with a respective bore 131 that receives a decompression actuating cam 132. These cams 132 are engageable with lift plungers 133 that engage the exhaust tappets 96. An actuating pin 134 extends through the outer end of the camshafts 92 and beyond the timing gear 86 within the case 129. These actuating pins 134 are actuated by an actuating mechanism shown in FIGS. 14 and 15 and identified generally by the reference number 135. This mechanism 135 will be described shortly and when so actuated will move the cams 132 so as to urge the plungers 133 outwardly and lift the exhaust tappets 97. This will, in effect, open the exhaust valves.

This is done during a portion of the compression stroke. As may be seen in FIG. 9, the pins 133 are generally aligned with the ends of the lift portions of the intake cam lobes 98 so that the exhaust valves will be opened at a time during the compression stroke and thus, relieve the pressure in the cylinder so as to make cranking and starting easier.

Figure 14:
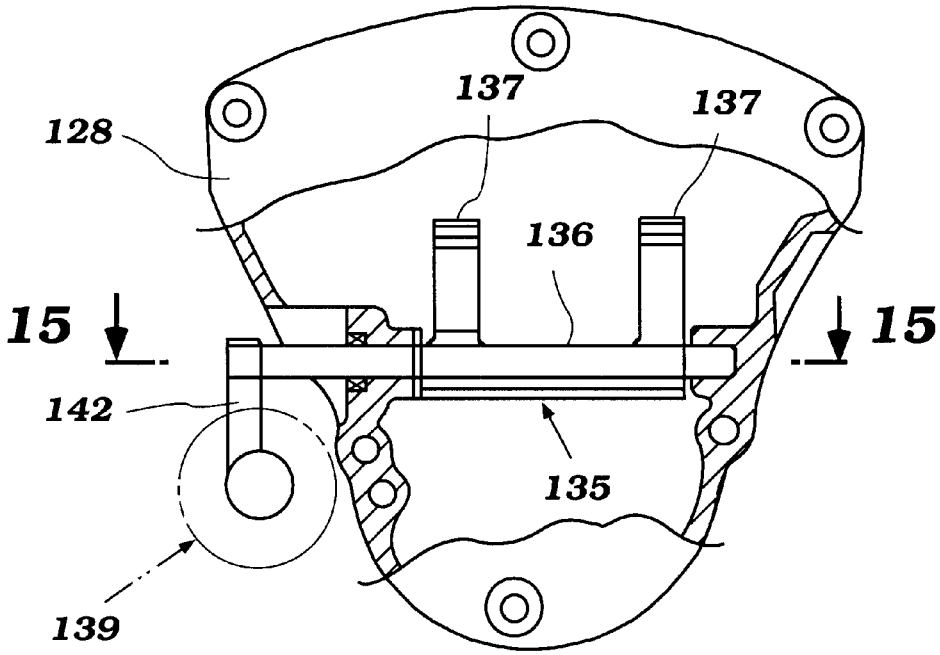
FIG. 14 is a view looking generally in the direction of the arrow 14 in FIG. 9 and shows the actuating device for the decompression system.
Figure 15:
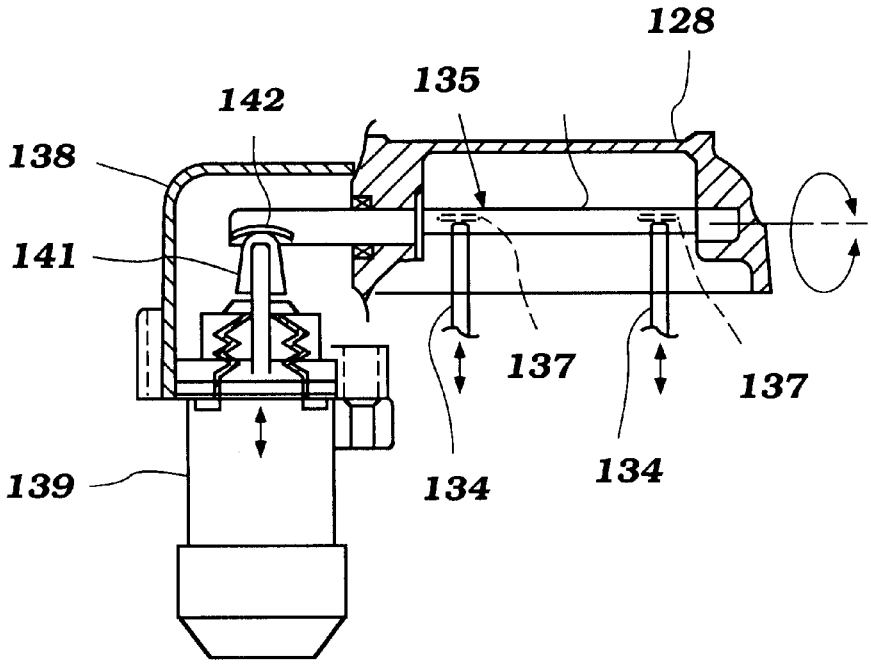
FIG. 15 is a cross sectional view taken generally along the line 15—15 in FIG. 14.

The actuating mechanism 135 will now be described by particular reference to FIGS. 14 and 15. The outer peripheral edge of the cover piece 128 journals an actuating shaft 136 and which shaft has a pair of actuator arms 137 which are juxtaposed to the ends of the push rods 134.

The shaft 136 extends transversely outwardly beyond the cover 128 and into a further cover and mounting member 138 that is fixed to the cover 128 in a suitable manner. A solenoid actuator 139 is carried by this cover 138 and has a plunger portion 141 that cooperates with a follower arm 142 on this extending end of the shaft 136.

When the actuator 139 is operated, it will rotate the shaft 136 so as to reciprocate the plungers 134 in the direction to lift the tappets 39 and provide the decompression of the engines during a portion of the compression stroke, as previously noted.

When the solenoid actuator 139 is deenergized, return springs that are trapped in the bores 131 and operate on the cam members 132 will return the plungers 134 to their normal engine operating non-decompression condition.

The solenoid actuator 139 may be operated either manually, if the engine is manually started, or may be operated simultaneously with operation of the engine starter motor. This starter motor is shown in FIG. 2 and is identified generally by the reference numeral 143. This starter motor operates on the crankshaft 39 through a suitable drive mechanism. The starter motor 143 is juxtaposed to an alternator 144 which is also driven from the engine crankshaft 39 in a suitable manner so as to provide electrical power for the system and to charge a battery (not shown).

Thus, from the foregoing description, it should be readily apparent that the engine construction is quite compact and provides a very effective way for operating the multiple valves for the engine while providing a decompression system for starting of the engine. Of course, the foregoing description is that of the preferred embodiment of the invention and various changes and modifications may be made without departing from the spirit and scope of the invention, as defined by the appended claims.

What is claimed is:

1. An internal combustion engine decompression system, said engine having a cam shaft with a plurality of cam lobes each of which cooperates with a follower for operating valves of said engine, said cam shaft being formed with an axially extending bore in which an actuating cam member is supported for reciprocation, a plunger member supported for reciprocation in said cam shaft along an axis that is generally transversely disposed to said axially extending bore and inclined thereto so as to intersect said cam shaft at a point closely adjacent at least one cam lobe in an area spaced from its tip portion to engage said follower at a point closely adjacent the area where said tip portion engages said follower, and a decompression actuator for moving said actuating cam member in said bore for actuating said plunger to engage said follower and open the associated valve at a time during the stroke when said valve would normally be closed.

2. An internal combustion engine decompression system as set forth in claim 1 wherein the at least one cam lobe operates an exhaust valve for opening said exhaust valve during a portion of the compression stroke.

3. An internal combustion engine decompression system as set forth in claim 2 wherein there is also a cam on the cam shaft for operating an intake valve.

4. An internal combustion engine decompression system as set forth in claim 3 wherein the decompression actuator comprises an actuator shaft pivotal about an axis that is transverse to the axis about which the cam shaft rotates and which has an operating arm engaged with the actuating cam member.

5. An internal combustion engine decompression system, said engine having a pair of cam shafts journalled for rotation about parallel axes, each of said cam shafts having a plurality of cam lobes each of which cooperates with a follower for operating valves of said engine, each of said cam shafts being formed with an axially extending bore in which a respective actuating cam member is supported for reciprocation, a plunger member supported for reciprocation in each of said cam shafts along an axis that is generally transversely disposed to its respective axially extending bore and which intersects at least one cam lobe of the respective cam shaft in an area spaced from its tip portion, and a common decompression actuator for moving each of said actuating cam members in its respective bore for actuating the respective of said plungers to engage the respective of said followers and open the associated valve at a time during the stroke when said valve would normally be closed, said decompression actuator comprising an actuator shaft pivotal about an axis that is transverse to the axes about which said cam shafts rotate and which has a pair of operating arms each engaged with the actuating cam member of the respective cam shaft.

6. An internal combustion engine decompression system as set forth in claim 5 wherein the at least one cam lobe on each cam shaft operates an exhaust valve for opening said exhaust valve during a portion of the compression stroke.

7. An internal combustion engine decompression system as set forth in claim 6 wherein there is also a further cam on each cam shaft for operating a respective intake valve.

* * * * *